US006154140A

United States Patent [19]

Thorpe et al.

[11] Patent Number: 6,154,140

[45] Date of Patent: Nov. 28, 2000

[54] INTELLIGENT PERSONAL UNDERWATER MONITORING DEVICE

[75] Inventors: Steven W. Thorpe, North Kingstown; Robert C. Higgins, Tiverton, both of R.I.

[73] Assignee: The United States of America as represented by the Secretary of the Navy, Washington, D.C.

[21] Appl. No.: 09/413,059

[22] Filed: Oct. 4, 1999

[51] Int. Cl.[7] ..... G08B 23/00

[52] U.S. Cl. ..... 340/573.6; 340/626; 367/131

[58] Field of Search ..... 340/626, 573.6, 340/573.1, 506; 367/131, 141, 910

[56] References Cited

U.S. PATENT DOCUMENTS 4,932,009 6/1990 Lynch ..... 367/153
5,097,254 3/1992 Merrithew ..... 340/573
5,185,605 2/1993 Roberts, Jr. et al. ..... 340/850
5,268,673 12/1993 Nelson et al. ..... 340/566
5,408,222 4/1995 Yaffe et al. ..... 340/604
5,907,281 5/1999 Miller, Jr. et al. ..... 340/573.6

*Primary Examiner*—Daniel J. Wu
*Assistant Examiner*—Sihong Huang
*Attorney, Agent, or Firm*—Michael J. McGowan; Robert W. Gauthier; Prithvi C. Lall

[57] ABSTRACT

The present invention relates to an intelligent personal underwater monitoring system which recognizes when a swimmer is in trouble and transmits a warning signal. The system comprises a device worn by the swimmer which senses water pressure and transmits a first signal when a predetermined depth is passed by the swimmer. The system further comprises a device for receiving the signals generated by the device worn by the swimmer and a neural network processor for processing the signals and generating an output signal representative of whether the swimmer is in trouble and an alarm signal generation device.

20 Claims, 2 Drawing Sheets

INTELLIGENT PERSONAL UNDERWATER MONITORING DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an intelligent safety alert system which recognizes when a swimmer is in trouble and transmits an alarm or warning signal to a parent, companion, and/or monitor.

(2) Prior Art

Water safety devices are known in the prior art. U.S. Pat. No. 4,932,009 to Lynch illustrates one such device and a method for detecting the presence of submerged, possibly distressed swimmers. The Lynch device employs a plurality of pairs of transducers arranged on opposite sides of a body of water. Pulsed sequential excitation of the transducers is employed to monitor the body of water. A person disposed between a pair of transducers interrupts the transmission of ultrasonic waves. An alarm is triggered upon the interruption of the ultrasonic waves or after a delay to avoid false alarms, warning of the presence and location of a submerged, lingering swimmer even in the presence of other active swimmers in the body of water. One of the problems with this type of device however is that it can not be easily used in open bodies of water.

U.S. Pat. No. 5,097,254 to Merrithew illustrates a device worn by a swimmer. The device includes a portable sonic signal generating member having a switch or similar device which is activated at a predetermined depth. The device also includes a timer for detecting immersion at the predetermined depth for the predetermined time. On immersion occurring at the predetermined depth for the predetermined time, a sonic signal is generated, and detected by a receiver mounted in the pool. An alarm signal is generated to operate an alarm device. Again, the device is not one which could be used in open bodies of water.

U.S. Pat. No. 5,408,222 to Yaffe et al. illustrates another device, worn by a swimmer, for issuing a warning when a person is submerged beneath water. The device comprises a timing circuit having first and second terminals. The timing circuit is responsive to a voltage applied to the first terminal for connecting the second terminal to the first terminal after a predetermined time interval. An alarm unit is connected to the second terminal of the timing circuit. A normally open water-sensitive switch is attached to a part of the person's body which is normally above water and is coupled to the first terminal of the timing circuit. An electrical supply is coupled to the water-sensitive switch for applying the required voltage to the first terminal of the timing circuit when the water-sensitive switch is submerged beneath water. A normally deflated float may be worn by the person so as to be automatically inflated in response to the alarm signal.

U.S. Pat. No. 5,268,673 to Nelson et al. illustrates a swimming pool alarm responsive to wave motion that produces a signal when two waves exceeding a threshold level of amplitude are sensed within a preset duration of time. A transducer senses air or water pressure changes and produces electrical signals corresponding to the changes. A comparator system, connected to the transducer, receives the transducer signals and, if the signals exceeds a preset threshold level, transmits a signal to a discriminator. The discriminator times the signals received from the comparator and when two signals are received within a specified period of time, a third signal is generated. A warning device such as an alarm is connected to the discriminator and is activated by the third signal.

None of these devices has the capability to recognize the characteristics that indicate when a swimmer is in trouble. These devices produce an underwater signal and a subsequent alarm when a pressure threshold is exceeded or when a period of time has elapsed. In these cases, the swimmer may or may not have a problem. The potential for frequent false alarms exists.

Despite the existence of these devices, most frequently lifesaving personnel and concerned parents depend on visual recognition of a potential problem when children are playing in water. This means of detection is subject to human error and sometimes results in tragedy. The element of distraction and the inability to track a child in a crowded environment increase the risk of a problem.

SUMMARY OF THE INVENTION

Accordingly, it is an object of the present invention to provide an intelligent safety alert system which is capable of recognizing when a swimmer is in trouble and transmitting a warning signal.

It is a further object of the present invention to provide an intelligent safety alert system as above that recognizes normal swimming characteristics for different levels of swimmers and has the ability to produce an alert when a swimmer's behavior differs from normal swimming activities.

It is still a further object of the present invention to provide an intelligent safety alert system as above which has an alarm that triggers when a swimmer is in trouble or in danger of drowning or when a swimmer's behavior deviates from the norm.

The foregoing objects are attained by the intelligent safety alert system of the present invention.

In accordance with the present invention, an intelligent safety alert system for a swimmer is provided which comprises a device worn by the swimmer which senses water pressure and transmits an acoustic signal when a predetermined depth is passed by the swimmer. The system further comprises means for receiving the acoustic signal generated by the swimmer worn device and means for processing the acoustic signal and generating an output signal representative of the condition of the swimmer. The system still further comprises means for generating a warning or an alarm signal when an output signal representative of a swimmer in trouble is generated.

Other details of the safety alert system of the present invention, as well as other objects and advantages attendant thereto, are set forth in the following description and the accompanying drawings in which like reference numerals depict like elements.

DESCRIPTION OF THE PREFERRED EMBODIMENT(S)

Figure 1:
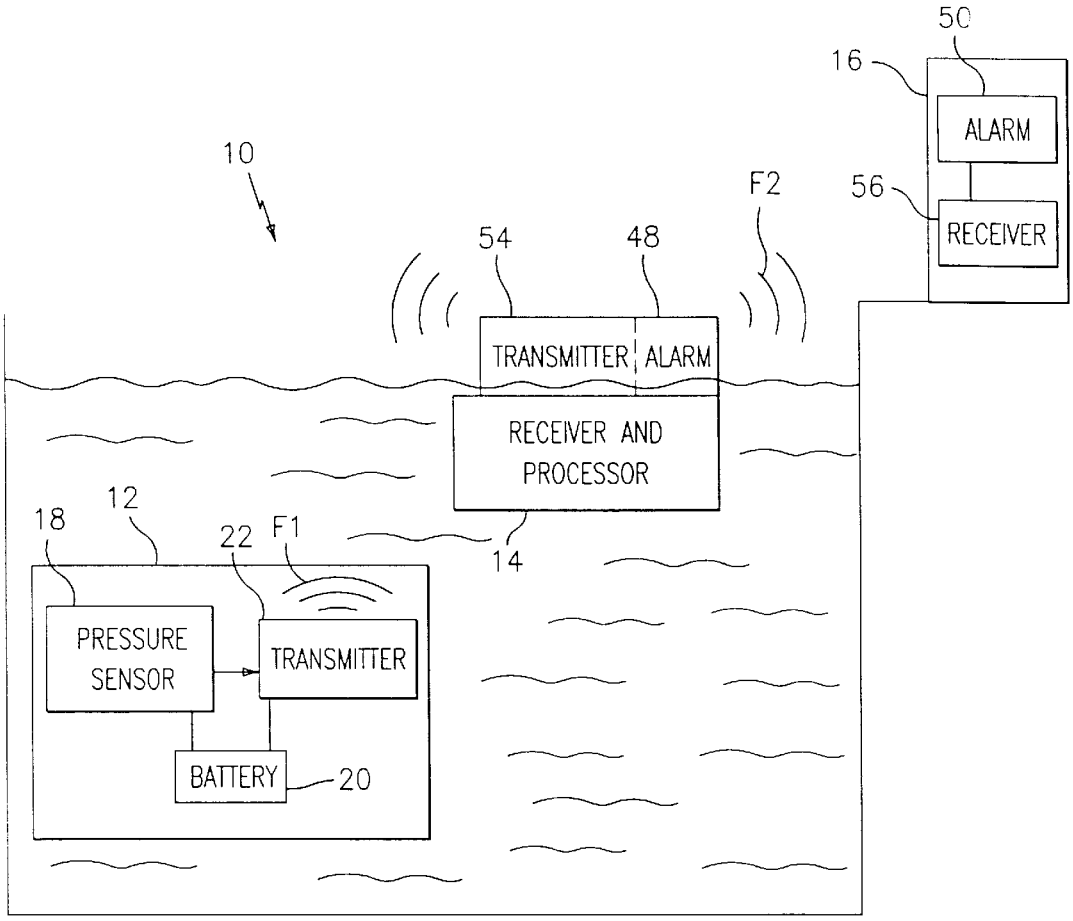
FIG. 1 is a schematic representation of the components of the safety alert system of the present invention.

Referring now to the drawings, a high level functional diagram showing the basic configuration of the intelligent safety alert system 10 of the present invention is shown in FIG. 1. The system 10 has three separate components: a pressure sensor/transmitter device 12 to be worn by the swimmer; an in-water receiver/processor device 14 such as a sonobouy; and an above water receiver/alarm device 16. The in-water receiver/processor device 14 preferably is located in the water, such as in the vicinity of a parent or a swimming companion. The receiver/alarm device 16 is preferably located outside of and above the body of water near a monitoring person, such as a lifeguard.

The pressure sensor/transmitter device 12 is embedded in an object worn by the swimmer. The object could be a necklace, an earring, a wristband, or a pair of water goggles worn by the swimmer. The device 12 can be embedded in any suitable manner known in the art. For example, if the device 12 is embedded within a necklace, the necklace could have a waterproof casing (not shown) in which the device 12 is located.

The device 12 includes a pressure sensor 18 for determining the depth of the swimmer and a transmitter 22 for generating an acoustic signal. The pressure sensor 18 may comprise any suitable pressure sensor known in the art and may be powered by a battery 20. The pressure sensor which is utilized however should be capable of producing a trigger signal to the acoustic transmitter 22 each time the water pressure reaches a preset depth. The transmitter 22 may comprise any suitable transmitter circuit known in the art for generating an acoustic signal in the form of a sequence of sinusoidal pulses. The transmitter 22 may also be powered by the battery 20.

In a preferred embodiment of the present invention, the pressure sensor 18 has five preset depths at which a trigger signal is produced. Once the transmitter 22 receives a trigger signal from the pressure sensor 18, a sequence of sinusoidal acoustic pulses is transmitted at frequency F1. The pulse duration preferably varies as a function of depth. For example, when the swimmer is at the surface, the pulse duration is 10 msec; at 1 foot in depth, the pulse duration is 20 msec; at 2 feet in depth, the pulse duration is 30 msec; at 3 feet in depth, the pulse duration is 40 msec; and over 4 feet in depth, the pulse duration is 50 msec. The transmitter circuitry is such that as the swimmer swims through a depth threshold, the previous pulse sequence is turned off and a new pulse sequence is initiated. If a swimmer stays at the water surface, then only 10 msec pulses are transmitted. If the swimmer swims to the bottom of the pool, a different sequence of pulses are transmitted at each preset depth. Of course, the foregoing depths and pulse durations are merely illustrative. The pressure sensor 18 can be set for any desired depths for triggering a trigger signal and for generating pulses of any desired duration.

Figure 2:
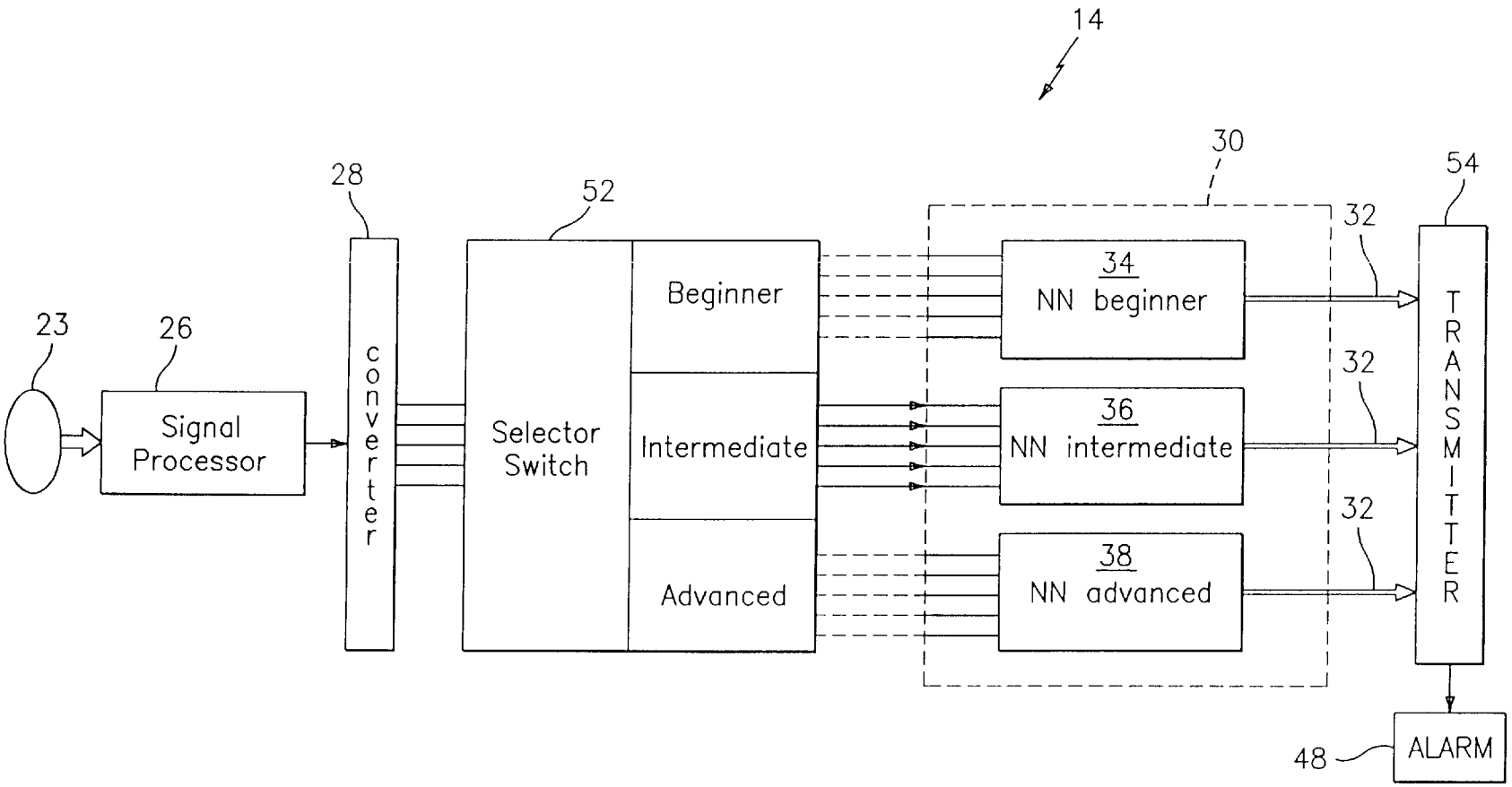
FIG. 2 is a schematic representation of the in-water device component of the safety alert system of FIG. 1.

FIG. 2 shows the configuration of the in-water receiver/processor device 14. As can be seen from this figure, the device 14 includes, a receiver 23 for receiving the acoustic pulses generated by the transmitter 22. The acoustic pulses thus received pass through a signal processor 26 which reduces background noise, detects the signal and determines the pulse duration. The processor 26 may comprise any suitable processor or processors known in the art.

The pulse duration value is digitized by the converter 28 and represented as a 5 bit binary number with the 50 msec pulses preferably represented as 11111, and the 10 msec pulses preferably represented as 00001. The digitized pulses are transmitted to a neural network processor 30 which is trained to recognize a normal pattern of pulses of a swimmer who is not in any danger and which will produce an output signal 32 that will trigger an alarm or warning when the pulse pattern deviates from the normal sequence.

Figure 3:
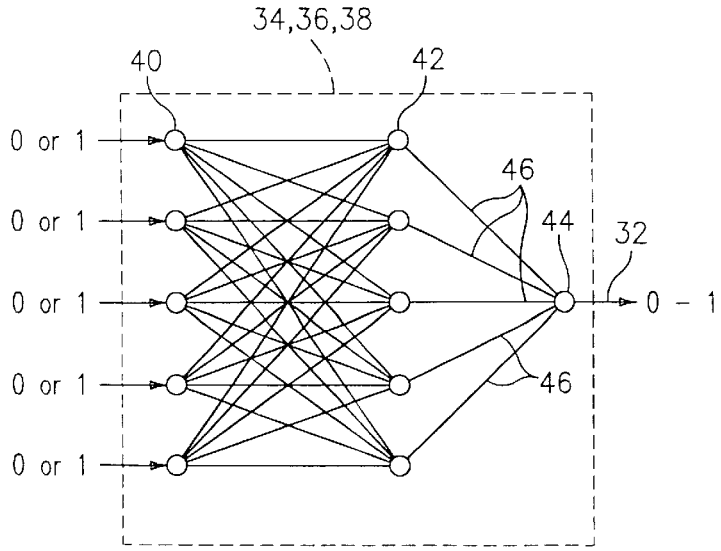
FIG. 3 is a schematic representation of an embodiment of the neural networks used in the in-water device component of FIG. 2.

The neural network processor 30 actually comprises three neural networks 34, 36 and 38. The neural network 34 comprises a neural network trained to recognize the normal pattern of pulses of a beginner swimmer. The neural network 36 comprises a neural network trained to recognize the normal pattern of pulses of an intermediate swimmer. The neural network 38 comprises a neural network trained to recognize the normal pattern of pulses of an advanced swimmer. As shown in FIG. 3, each of the neural networks 34, 36, and 38 has five input neurons 40, five hidden layer neurons 42 and one output neuron 44. Each input neuron 40 receives a digitized signal representing a 0 or a 1 from the converter 28 and is connected to each hidden layer neuron 42. Each hidden layer neuron 42 sends a signal 46 to the output neuron 44. The output neuron 44 of each neural network generates an output signal 32 that ranges from 0 to 1. A neural network output near zero means that the swimmer is behaving in a normal fashion and there are no apparent problems. A neural network output near one indicates non-normal behavior that requires attention by the monitoring person. In event of an output signal near one, the neural network processor 30 transmits an electronic signal to an alarm or warning device 48 positioned above the level of the water and/or to a transmitter 54 for generating a signal at a desired frequency F2 which forms part of the device 14. In a preferred embodiment of the present invention, the transmitter 54 also is positioned above the level of the water.

As shown in FIG. 1, the signal at frequency F2 generated by the transmitter 54 is received by a receiver 56 within the above water device 16. Upon reception of the signal at frequency F2, the receiver 56 transmits a signal to an alarm or warning device 50 which also forms part of the device 16.

The alarm or warning devices 48 and 50 may comprise any suitable alarm or warning devices known in the art. For example, the alarm device 48 could be a device which generates an audible sound to gain the attention of a swimming companion or parent. Similarly, the alarm device 50 could be a device which generates an audible sound for gaining the attention of a monitor such as a lifeguard. Alternatively, the alarm device 50 could be a device which generates a graphic display to the monitor. The transmitter 54 for generating the signal at frequency F2 and the receiver 56 may comprise any suitable transmitter circuit or receiving circuit respectively known in the art.

Referring again to FIG. 2, a switch 52 is provided so that a parent or a companion accompanying the swimmer can select the level of skill of the swimmer being monitored. For example, the switch 52 may be set to one of three swimming competence levels-beginner, intermediate, and advanced. This setting defines which one of the neural networks 34, 36, and 38 receives digitized signals from the converter 28. FIG. 2 illustrates a setting which is that of an intermediate level swimmer. The connection between switch 52 and neural network 36 is thus shown as solid while connections to neural networks 34 and 38 are shown as dashed.

The neural network processor 30 may comprise any suitable programmed processor known in the art. The neural networks 34, 36, and 38 may be trained using any suitable technique known in the art. Preferably, a back propagation model is used for the neural network topology because it lends itself to supervised learning. Any suitable back propagation algorithm known in the art may be used to train the neural network. In a preferred embodiment of the present invention, each of the neural networks 34, 36, and 38 is trained by recording the pulse sequences that characterize a particular level of swimmer. For example, data can be initially gathered with 10 or more beginners in the pool for a period of 15 minutes; however, the number of swimmers and/or the period can be varied to increase the reliability and accuracy of the results. Based on the pattern of the sequence of pulses collected for each swimmer, the neural network 34 for beginners is trained and the adaptive weights are established via a feedback mechanism to produce a neural network output of zero when these beginners are in no danger or when their swimming behavior is normal; and to produce an output of one when behavior is not normal. Data is then collected for intermediate and advances swimmers and the neural networks 36 and 38 are trained. The set of neural network weights should be different for each of the three neural networks 34, 36, and 38.

As can be seen from the foregoing discussion, the safety alert system 10 of the present invention has the intelligence to recognize normal swimming characteristics for different levels of swimmers and the capability to produce an alert when the swimmer's behavior deviates from normal swimming activities. In the alert system 10 of the present invention, an alarm or warning will trigger when a swimmer is in trouble or in danger of drowning or when the swimmer's behavior deviates from the norm.

While the safety alert system of the present invention has been described in the context of monitoring a swimmer within a pool, it can be used in environments other than a pool such as in open water. This is due to the fact that none of the components of the system have to be attached to a part of the pool. For example, a sensor/transmitter device 12 could be worn by snorkelers or divers swimming in an ocean or a lake. In such instances, the in-water receiver/processor device 14 could be a sonobouy floating in the ocean or the lake and the receiver alarm device 16 could be positioned on shore, on a boat, or on a floating platform. Alternatively, the in-water receiver/processor device 14 may be a wrist-worn unit worn by all members of a snorkeling/diving team to inform team members when one member is experiencing difficulty. When used in such environments, the safety alert system 10 can be modified to provide an alert when an individual exceeds preset depth conditions. That is, if during diving operations, a diver is expected to maintain a depth of 50–75 feet, the device 12 worn by the diver could be preset to sound an alert when these thresholds are exceeded. Similarly, the device 12 worn by the diver could be modified to allow for an alert when the behavior of the diver differs from that of his or her group's behavior.

The safety alert system of the present invention can also be used in connection with other water activities/operations associated with military and commercial vessels and recreational pleasure craft.

Still further, when there are multiple safety units operating in an area, each swimmer could be provided with a sensor/transmitter device 12 that operates at a unique frequency. Further, if desired, an in-water receiver/processor device 14 could be supplied for each swimmer. In such a system, each transmitter 22 and/or 54 may be designed, together with signal processor 26, to allow for the selection and transmission of a different frequency or may be designed to transmit an FSK (Frequency Shift Key) type signal with a combination of several frequency settings. The specific combination of frequencies utilized would be physically selected by the swimmer, the parent, and/or the swimmer's companion to help maintain the uniqueness of the swimmmer's unit. This has the advantage of providing the parent, companion, or monitor with an ability to identify each individual swimmer so as to determine whether that swimmer is in distress or not.

While a single receiver alarm device 16 could be used in a multi-swimmer system, it should be apparent that multiple devices 16 having unique alarm sounds, one for each swimmer, could be used if desired.

While the neural networks 34, 36 and 38 have been shown as having an architecture with five input neurons, five hidden neurons, and one output neuron, other types of neural network architectures can be used if desired.

It is apparent that there has been provided an intelligent personal underwater monitoring device which fully satisfies the means, objects, and advantages set forth hereinbefore. While the present invention has been described in the context of preferred embodiment(s) thereof, other variations, alternatives, and modifications will be apparent to one of skill in the art having read the instant description. It is intended to embrace such variations, alternatives, and modifications as fall within the broad scope of the appended claims.

What is claimed is:

1. A safety alert system for use by a swimmer comprising:

means for sensing water pressure;

means for transmitting a first signal each time a predetermined depth is passed by said swimmer;

means for receiving each said first signal;

means for processing each said first signal so as to detect when said first signal deviates from a normal signal and to generate an output signal representative of whether swimmer behavior is normal or not; and means for generating an alarm signal if said output signal indicates that said swimmer behavior is not normal.

2. A safety alert system according to claim 1 wherein said means for sensing water pressure and for transmitting said first signal are positioned within a device worn by said swimmer.

3. A safety alert system according to claim 2 wherein said device worn by said swimmer comprises at least one of a necklace, earring, wristband, and pair of water goggles in which said water pressure sensing means and said first signal transmitting means are embedded.

4. A safety alert system according to claim 1 wherein said water pressure sensing means has a plurality of preset depths and transmits a trigger signal to said first signal transmitting means each time said water pressure reaches one of said preset depths.

5. A safety alert system according to claim 4 wherein said first signal transmitting means comprises means for transmitting a signal in the form of a sequence of sinusoidal pulses.

6. A safety alert system according to claim 1 wherein said means for receiving said first signal and said means for processing said first signal are positioned within an in-water device.

7. A safety alert system according to claim 6 wherein said in-water device comprises a sonobouy.

8. A safety alert system according to claim 6 further comprising means for digitizing each signal received by said receiving means and for transmitting said digitized signals to said processing means.

9. A safety alert system according to claim 1 wherein said means for processing said first signal comprises a neural network processor.

10. A safety alert system according to claim 9 wherein said neural network processor further comprises:

a first neural network for a first level of swimming competence;

a second neural network for a second level of swimming competence;

a third neural network for a third level of swimming competence; and switch means for selecting one of said neural networks.

11. A safety alarm system for use by a swimmer comprising:

means for sensing water pressure having a plurality of preset depths and transmitting a trigger signal each time said water pressure reaches one of said preset depths;

means for receiving said trigger signal and transmitting a first signal in the form of a sequence of sinusoidal pulses each time a predetermined depth is passed by said swimmer, said sequence of sinusoidal pulses having a pulse duration which varies as a function of depth;

means for receiving said first signal;

means for processing said first signal so as to generate an output signal representative of whether swimmer behavior is normal or not;

means for generating an alarm signal if said output signal indicates that said swimmer behavior is not normal.

12. A safety alert system for use by a swimmer comprising:

means for sensing water pressure having a plurality of preset depths and transmitting a trigger signal each time said water pressure reaches one of said preset depths;

means for receiving said trigger signal and transmitting a first signal in the form of a sequence of sinusoidal pulses each time a predetermined depth is passed by said swimmer, a first sequence of sinusoidal pulses being turned off as said swimmer passes through a depth threshold and a new sequence being initiated;

means for receiving said first signal;

means for processing said first signal so as to generate an output signal representative of whether swimmer behavior is normal or not; and means for generating an alarm signal if said output signal indicates that said swimmer behavior is not normal.

13. A safety alert system for use by a swimmer comprising:

means for sensing water pressure and for transmitting a first signal each time a predetermined depth is passed by said swimmer;

means for receiving said first signal;

a converter for digitizing signals received by said receiving means and producing an output having five numerical components;

a neural network processor for processing said five numerical components so as to generate an output signal representative of whether swimmer behavior is normal or not, said neural network processor having a first neural network for a first level of swimming competence, a second neural network for a second level of swimming competence, a third neural network for a third level of swimming competence and switch means for selecting one of said neural networks, each of said neural networks having five input neurons for receiving one of said numeral components when said neural network is selected, five hidden layer neurons, and one output neuron, each of said input neurons being connected to each of said hidden layer neurons and each of said hidden layer neurons being connected to said output neuron; and means for generating an alarm signal if said output signal indicates that said swimmer behavior is not normal.

14. A safety alert system according to claim 13 further comprising said output neuron generating said output signal and said output signal being representative of normal swimming behavior or non-normal swimming behavior.

15. A safety alert system according to claim 14 further comprising means for transmitting a non-normal swimming behavior signal to said alarm signal generating means upon receipt of a signal representative of non-normal swimming behavior from said output neuron.

16. A safety alert system according to claim 15 wherein said alarm signal generating means comprises means for generating an audible signal which can be heard by an individual other than said swimmer.

17. A safety alert system according to claim 15 wherein said alarm signal generating means comprises means positioned above said body of water for receiving said transmitted non-normal swimmer behavior signal for providing an alarm signal to a monitoring person.

18. A safety alert system for monitoring the conduct of a plurality of swimmers, said system comprising:

a device worn by each swimmer;

each said device comprising means for sensing water pressure and means for transmitting a signal at a frequency unique to a particular swimmer each time a predetermined depth is passed by the particular swimmer;

means for receiving said signals generated by said devices worn by said swimmers;

means for processing said generated signals to detect whether said generated signals deviate from a normal signal and for producing an output signal representative of the condition of each swimmer; and means for generating an alarm signal if said output signal for at least one swimmer indicates not normal swimming behavior.

19. The safety alert system according to claim 18 wherein said alarm signal is unique for each said swimmer so as to facilitate recognition of a particular swimmer in trouble.

20. The safety alert system according to claim 18 further comprising a receiving means and a processing means for each particular swimmer.

* * * * *